US007789009B1

(12) United States Patent
Brittingham

(10) Patent No.: US 7,789,009 B1
(45) Date of Patent: Sep. 7, 2010

(54) OMNI INDEXING MOUNT PRIMARILY FOR ATTACHING A NOISE SUPPRESSOR OR OTHER AUXILIARY DEVICE TO A FIREARM

(75) Inventor: Kevin Tyson Brittingham, Norcross, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 882 days.

(21) Appl. No.: 11/703,984

(22) Filed: Feb. 8, 2007

(51) Int. Cl.
*F41A 21/00* (2006.01)

(52) U.S. Cl. ..... 89/14.4; 89/14.2; 89/14.3; 181/223

(58) Field of Classification Search ..... 42/1.06; 89/14.2, 14.3, 14.4, 14.5, 14.6; 181/223
See application file for complete search history.

(56) References Cited

U.S. PATENT DOCUMENTS

| | | | | |
|---|---|---|---|---|
| 6,973,863 | B1 * | 12/2005 | Jones | 89/14.2 |
| 7,594,464 | B2 | 9/2009 | Dueck | |
| 7,676,976 | B2 | 3/2010 | Dueck et al. | |
| 2008/0098880 | A1 * | 5/2008 | Brugger | 89/14.4 |

* cited by examiner

*Primary Examiner*—Stephen M Johnson
*Assistant Examiner*—Daniel J Troy
(74) *Attorney, Agent, or Firm*—Wood, Herron & Evans LLP

(57) ABSTRACT

An apparatus and method for easily, and reliably attaching a noise suppressor or other auxiliary device to a standard A2 flash compensator typically located at the muzzle end of a firearm barrel and for easily, and reliably removing the noise suppressor or other auxiliary device there from through the novel ideal of providing an apparatus which consistently indexes a noise suppressor on the wrench flats of a standard A2 flash hider.

10 Claims, 2 Drawing Sheets

OMNI INDEXING MOUNT PRIMARILY FOR ATTACHING A NOISE SUPPRESSOR OR OTHER AUXILIARY DEVICE TO A FIREARM

BACKGROUND OF THE INVENTION

1. Field of Invention

This invention generally relates to firearms, specifically to systems for attaching a noise suppressor or other device to a 22 mm flash hider with wrench flats similar to that which is typically found on the United States military M16 rifles.

2. Prior Art

Previous systems exist for attaching noise suppressors to a firearm, and specifically for using a flash hider or other muzzle device as a mount for the noise suppressor. Gemtech, a silencer manufacturer, produces a product named "HALO" which also attaches to a standard U.S. military A2 flash hider. The HALO fails to provide a mechanical method for indexing the silencer repeatedly between uses creating a situation where the host firearms point of impact is variable each time the silencer is remounted. There is a need for a reliable, secure attachment system for mounting noise suppressors to a firearm, particularly a non proprietary flash hider, specifically the standard military "A2" flash compensator.

OBJECTS AND ADVANTAGES

The idea being presented as novel is a retention system built into a noise suppressor that uses the standard US military "A2" flash hider's wrench flats as a mounting surface. Using the wrench flats as a mounting surface allows the user to reliably and consistently orient the silencer on the muzzle of the host firearm.

Accordingly several objects and advantages of the present invention are (a) to provide the capability of attaching a noise suppressor to the wrench flat of a flash hider or other fixture with two 180 degree opposed surfaces; (b) to provide the capability to repeatedly index a noise suppressor to the barrel of a firearm using a non proprietary flash hider mount; and (c) to provide the capability to securely attach a noise suppressor to the common, standard A2 flash compensator.

Still further objects and advantages will become apparent from a consideration of the ensuing description and drawings.

SUMMARY

The present invention provides an apparatus and method for reliably attaching and repeatedly indexing a noise suppressor to the muzzle end of a firearm, and for easily removing such device there from. The present invention utilizes the wrench flats present on most flash hiders or other muzzle devices to provide a mating surface. which also serves as an indexing point for the noise suppressor. In a preferred embodiment of the invention, the flash hider used as a mount is the standard A2 flash compensator found on the United States Militaries M16A2 and M4 rifles. The internal mating surface found inside of the auxiliary apparatus is specifically machined to accept the wrench flats of the A2 compensator.

In general terms, the invention provides auxiliary apparatus for attachment to a firearm including a barrel having a longitudinal axis, comprising the combination of: a fixture adapted to be attached to the muzzle of the barrel coaxially there with two external 180 degree opposed mating surfaces; and an auxiliary device having a bore for coaxially receiving the fixture with internal mating surface for fixture, such device including a spring retaining latch, and a mating surface.

More specifically, a preferred embodiment according to the invention provides a auxiliary apparatus for attachment to a firearm including a barrel having a longitudinal axis, comprising the combination of: a standard United States military A2 flash compensator adapted to be attached to the muzzle of the barrel coaxially there with and including two external flat surfaces 180 degrees opposed, and a noise suppressor incorporating the auxiliary device, including a locking mechanism and bore for receiving the A2 flash compensator, the locking mechanism integrating the mating surface for A2 flash compensator, and the locking mechanism also incorporates a spring which acts as a retention system when used with the bore which is integral to the noise suppressor.

In a preferred embodiment of the method, the external mating surfaces needed to affix the noise suppressor is provided by a standard A2 flash compensator coaxially affixed to the barrel, and a auxiliary device comprising a noise suppressor which can be temporarily and securely affixed to the A2 flash compensator by engaging the internal mating surfaces on the A2 flash compensator with tile rear cap, and threading the noise suppressor onto the rear cap; the rear cap is marked with "UP" to indicate the direction which the silencer is to be oriented.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
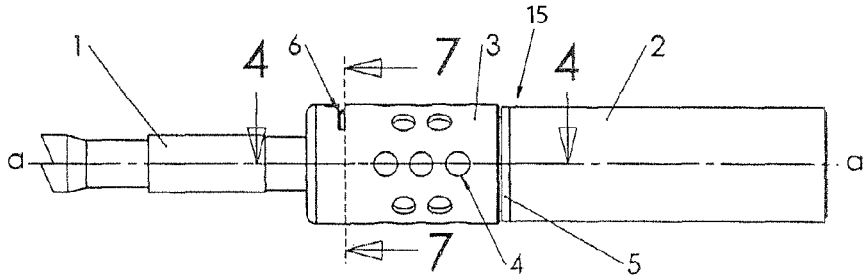
FIG. 1 shows an external side view of the proposed mounting system used to couple an auxiliary device to a fixture and barrel.

Starting with FIG. 1, there is an illustration of a barrel 1, an auxiliary device 2 (preferred embodiment noise suppressor 2), and the proposed mounting system 15 encompassing the rear cap 3, weight relief apertures 4, orientation indicator 7, mount 5 and the spring relief slot 6. The longitudinal axis is represented as a.

Figure 2:
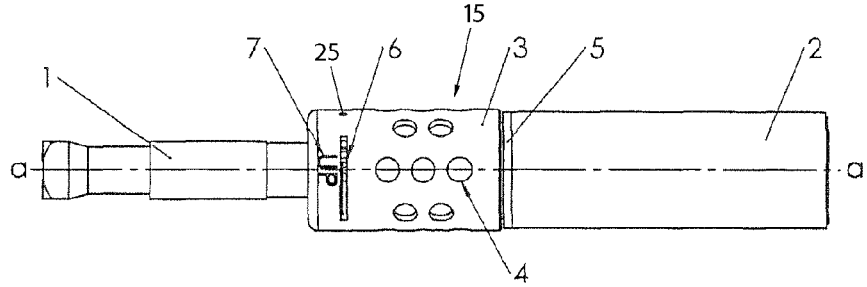
FIG. 2 shows a top view of the proposed mounting system in a first position.

In FIG. 2, there is illustrated a top view of barrel 1, preferred embodiment noise suppressor 2, and the proposed mounting system 15 encompassing the rear cap 3, weight relief apertures 4, orientation indicator 7, mount 5 and the spring relief slot 6. The laser engraved orientation indicator ("up") 7 is used to orient the preferred embodiment of the noise suppressor 2 every time.

Figure 3:
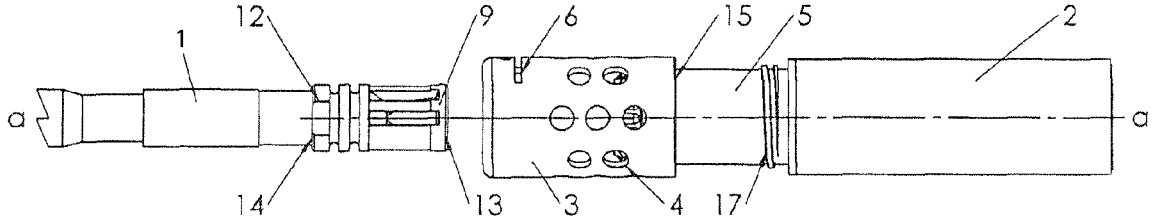
FIG. 3 shows an external side view of the mounting system in a second position.

In FIG. 3, there is illustrated a side view of the proposed mounting system 15 in a second position showing how the mounting system 15 the preferred embodiment noise suppressor 2, barrel 1, and a fixture 9 such as a flash compensator 9 appear before installation occurs. The locking thread 17 which threadedly secures rear cap 3 on mount 5 is shown. The preferred embodiment of the flash compensator 9 is shown with a forward surface 13, a pair of flat surfaces referred to as wrench flats 12, and a rear surface 14.

Figure 4:
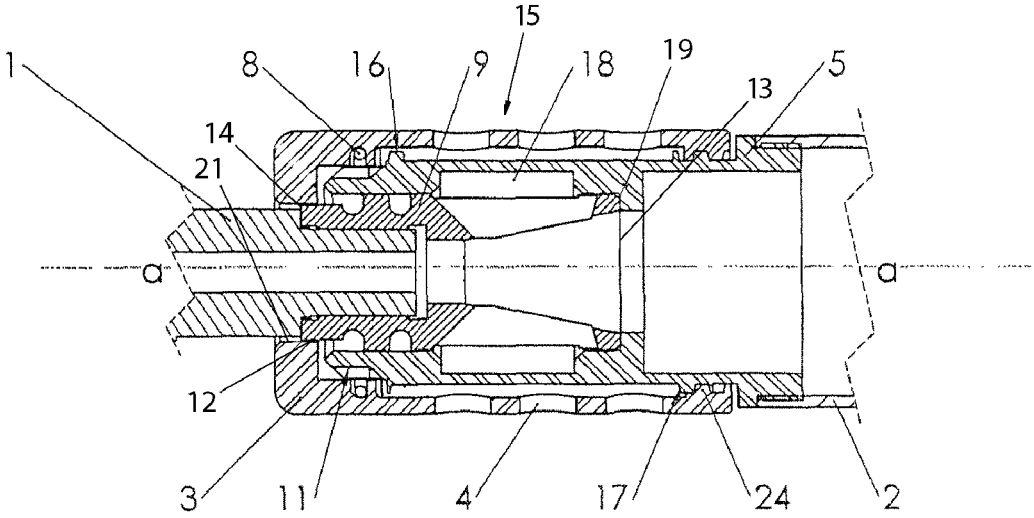
FIG. 4 shows an internal, top view of the proposed mounting system along line 4-4 of FIG. 1.

As used herein, the word "front" or "forward" corresponds to the firing direction of the firearm (i.e., to the right as shown in FIGS. 1, 2, and 4); "rear" or "rearward" or "back" corresponds to the direction opposite the firing direction of the firearm (i.e., to the left as shown in FIGS. 1, 2, 3, and 4); "longitudinal" means the direction along or parallel to the longitudinal axis a of the barrel 1 of the firearm or of the flash compensator 9 or of the noise suppressor 2; and "transverse" means a direction perpendicular to the longitudinal direction.

FIG. 4 illustrates an internal, side view of the barrel 1, holes 4, a spring latch 8 located in rear cap 3, which is retained on the mount 5 by a retention thread 16, preferred embodiment noise suppressor 2, a plurality of mount locking detents 11 located about mount 5, and a gas expansion area 18 around flash compensator 9. The flash compensator 9 includes wrench flats 12 engaged by rear cap 3. Also shown are the forward surface 13, and rear surface 14 of flash compensator 9. Rear cap 3 is retained about mount 5 by locking thread 17. Rear cap 3 provides a rear seating surface 20 for the rear surface 14 of flash compensator 9, and a pair of locking surfaces 21 for wrench flats 12, and the mount 5 provides a forward seating surface 19 for the forward surface 13 of the flash compensator 9.

Figure 5:
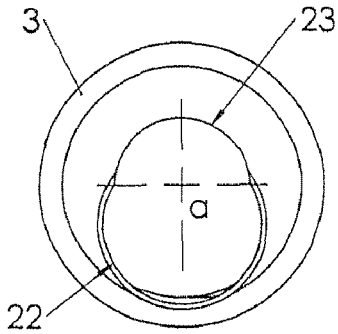
FIG. 5 shows a rear view of the proposed mounting system.
Figure 6:
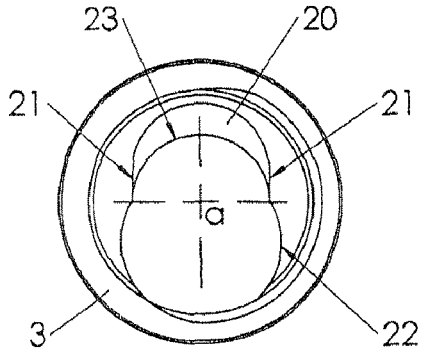
FIG. 6 shows an internal forward view of the proposed mounting system.

FIGS. 5-6 show views of the rear cap 3. FIG. 5 shows the eccentric opening portion 22 for inserting flash compensator 9, and the concentric opening portion 23 to clear barrel 1. FIG. 6 shows an internal view of rear cap 3 which shows the location of rear seating surface 20 for the rear surface 14 of the flash compensator 9 and the pair of locking surfaces 21 for wrench flats 12.

Figure 7:
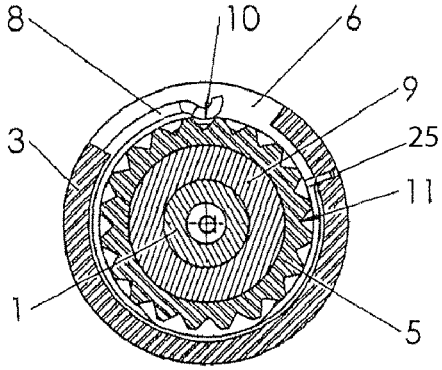
FIG. 7 shows an internal forward view of the proposed mounting system along line 7-7 of FIG. 1.
Figure 8:
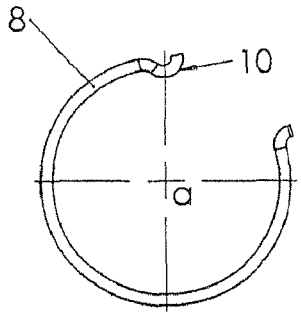
FIG. 8 shows a forward view of the spring latch.

FIGS. 7-8 illustrate spring latch 8 and spring locking detent 10 rotationally restraining rear cap 3 about mount 5 where spring locking detent 10 is engaging the plurality of mount locking detents 11. Spring relief 6 allows spring locking detent 10 to move away from mount locking detents 11 as rear cap 3 is threaded on. Barrel 1 and flash compensator 9 are also shown in their orientation while rear cap 3 is secured about mount 5.

In a preferred embodiment according to the present invention, the flash compensator 9 includes rear surface 14, forward surface 13, and wrench flats 12 which serve as indexing points for rear cap 3. Rear cap 3 provides an eccentric opening 22 for insertion of flash compensator 9 and a smaller concentric opening 23 which will clear the barrel 1.

The noise suppressor 2 includes a mount 5 having a longitudinal bore for coaxially receiving flash compensator 9 and barrel 1. The noise suppressor 2 further includes a sound suppressing front section fixedly secured to the mount 5. Noise suppressing sections of firearm noise suppressors are well known in the firearms art.

The rear portion of the mount 5 includes the annular row of mount locking detents 11, and the internal forward seating surface 19 for flash compensator 9. The forward seating surface 19 provides tension to aid in restraining the movement of noise suppressor 2 when rear cap 3 is secured to the mount 5.

A spring latch 8 with spring locking detent 10 is secured about rear cap 3 via spring retaining hole 25. A spring relief slot 6 is machined into rear cap 3, to allow movement of the spring latch 8, as it is rotated around mount 5 resulting in the up/down movement of spring locking detent 10. This prevents the rear cap 3 from rotating and backing off of the mount 5 during the incidental vibrations which result from discharging a firearm.

When installing the noise suppressor 2 onto the flash compensator 9, the rear cap 3 has the pair of locking surfaces 21 which engages wrench flats 12 on flash compensator 9. Also, the rear cap 3 has the rear seating surface 20 which locks about the rear surface 14 of flash compensator 9. The forward surface 13 of the flash compensator seats against the forward seating surface 19 as shown in FIG. 4. The rear cap 3 threads onto mount 5 by the presence of locking thread 24 and locking thread 17.

To install the noise suppressor 2 on the flash compensator hider 9, while in the second position the flash compensator 9 is inserted through eccentric opening 22 into bore of mount 5 where barrel 1 will clear concentric opening 23. Rear cap 3 is oriented in such manner where the orientation indicator 7 engraving "UP" is facing the appropriate direction while flash compensator 9 is then pulled rearward to engage rear surface 14 and wrench flats 12 into the rear seating surface 20 and pair of locking surfaces 21 of rear cap 3. Noise suppressor 2 and mount 5 are then moved rearward till resistance is felt at a first position at which time the rear cap 3 is threadedly rotated about mount 5 by locking thread 24 and locking thread 17. When rear cap 3 is full seated to noise suppressor 2 by locking thread 24, the flash compensator's forward surface 13 is seated against internal forward seating surface 19 of the mount 5. Spring latch 8 and spring locking detent 10 engage mount locking detents 11 while rear cap 3 is engaging locking thread 17. Spring relief slot 5 allows spring locking detent 10 movement as it slides over numerous mount locking detents 11 coming to rest only when forward seating surface 19 is seated against the forward surface 13 of the flash compensator 9.

Upon such installation, the noise suppressor 2 is fixedly secured to the flash compensator 9 (and hence to the barrel 1) both longitudinally and rotationally.

To remove the noise suppressor 2 from the firearm barrel 1, noise suppressor 2 is rotated in the reverse unthreading it from locking thread 17 thus freeing the rear cap 3 from mount 5. The mount 5 may be forwardly longitudinally withdrawn from flash compensator 9, which frees the flash compensator 9 to be withdrawn through eccentric opening 22, freeing the noise suppressor with mount 5 from barrel 1 and flash compensator 9.

Thus, there has been described a preferred embodiment of a mounting system for easily, and reliably orienting, attaching and indexing noise suppressor or other auxiliary device to the muzzle end of a firearm by mean of two flat surfaces 180 degrees opposed which are transverse to the axis of the barrel, and for easily removing the device there from, as well as a method for such attachment. Other embodiments of the present invention, and variations of the embodiment described herein, may be developed without departing from the essential characteristics thereof. Accordingly, the invention should be limited only by the scope of the claims listed below.

CONCLUSION, RAMIFICATIONS, AND SCOPE

Accordingly the reader will see that, according to the invention, I have provided a system for securely attaching a noise suppressor to a firearm equipped with the prolific A2 flash compensator. 1 have also afforded any user of my invention the ability to consistently orient the noise suppressor on the host firearms barrel by using the wrench flats located on the A2 flash compensator. Further is can be seen that by engraving "up" on the rear cap of the silencer, the user will have no trouble constantly orienting the silencer onto the muzzle of a host firearm.

While my above drawings and description contain many specificities, these should not be construed as limitations on the scope of the invention, but rather as an exemplification of one preferred embodiment thereof. For example the internal mating surface located in the rear cap of the auxiliary apparatus can be adapted to work with the wrench flats present on a variety of other flash compensators commercially available. It is also possible to machine the host firearms barrel to incorporate the external dimensions of the A2 flash compensator and thus directly attach the apparatus and noise suppressor to the barrel.

Accordingly, the scope of the invention should be determined not by the embodiments illustrated, but by the appended claims and their legal equivalents.

The invention claimed is:

1. A mounting system configured to couple an auxiliary device to a firearm having a barrel defining a longitudinal axis and a fixture coaxially secured to the barrel, the fixture including a forward surface, a rear surface, and a pair of flat surfaces 180 degrees opposed to each other adjacent the rear surface, the mounting system comprising:

a rear cap including an internal bore extending from a rear end to a forward end, the forward end including a first locking thread, the rear end including an opening in communication with the internal bore and having a concentric opening portion sized to receive the barrel and centered along the longitudinal axis, and an eccentric opening portion along one side of the concentric opening portion and sized to receive the fixture, the rear end also including a pair of locking surfaces and a rear seating surface adjacent the concentric opening portion and opposing the eccentric opening portion; and a mount extending rearwardly from the auxiliary device and inserted into the internal bore of the rear cap through the forward end of the rear cap, the mount including a forward seating surface configured to engage the forward surface of the fixture, a second locking thread configured to mate with the first locking thread of the rear cap, and a rear portion configured to seat within the internal bore between the fixture and the rear cap, wherein the rear cap is axially slidable with respect to the mount between a first position wherein the first locking thread and second locking thread are adjacent for engagement, and a second position wherein the rear portion of the mount is disposed adjacent to the forward end of the rear cap, wherein the mounting system couples the auxiliary device to the firearm by (i) sliding the rear cap to the second position with respect to the mount, (ii) inserting the fixture into the rear cap through the eccentric opening portion, (iii) moving the pair of locking surfaces and the rear seating surface of the rear cap into respective engagement with the pair of flat surfaces and the rear surface of the fixture, thereby positioning the barrel of the firearm in the concentric opening portion, (iv) sliding the rear cap to the first position with respect to the mount such that the forward seating surface of the mount engages the forward surface of the fixture, and (v) rotating the rear cap with respect to the mount along the longitudinal axis to threadably engage the first locking thread and the second locking thread, wherein the respective engagements of the forward surface and the rear surface of the fixture with the forward seating surface of the mount and the rear seating surface of the rear cap prevent longitudinal movement of the auxiliary device with respect to the fixture and the barrel, and the engagement of the pair of flat surfaces of the fixture and the pair of locking surfaces of the rear cap prevents rotational movement of the auxiliary device with respect to the fixture and the barrel.

2. The mounting system according to claim 1, wherein the auxiliary device is a noise suppressor.

3. The mounting system according to claim 1, wherein the fixture is a flash compensator.

4. The mounting system according to claim 3, wherein the mount includes a gas expansion area defined around the flash compensator.

5. The mounting system of claim 1, wherein the rear portion of the mount includes a retention thread configured to abut the first locking thread of the rear cap in the second position of the rear cap.

6. The mounting system of claim 1, wherein the rear portion of the mount includes a plurality of locking detents and the rear cap includes a spring latch having a first end with a spring locking detent configured to engage the plurality of locking detents of the mount to prevent undesirable unthreading of the mount from the rear cap caused by vibrations of the firearm.

7. The mounting system of claim 6, wherein the rear cap includes a spring relief portion configured to permit the spring locking detent of the spring latch to move out of engagement with the plurality of locking detents of the mount.

8. The mounting system of claim 6, wherein the rear cap includes a spring retaining hole for engaging a second end of the spring latch.

9. The mounting system of claim 1, wherein the rear cap further includes an orientation indicator configured to align the pair of flat surfaces of the fixture with the pair of locking surfaces of the rear cap.

10. The mounting system of claim 1, wherein the rear cap includes a plurality of apertures between the forward end and the rear end.

* * * * *